US010525523B2

(12) United States Patent
Koppensteiner et al.

(10) Patent No.: US 10,525,523 B2
(45) Date of Patent: Jan. 7, 2020

(54) METHOD AND DEVICE FOR FORGING A WORKPIECE IN BAR FORM

(71) Applicant: GFM—GmbH, Steyr (AT)

(72) Inventors: Robert Koppensteiner, Steyr (AT); Paul Zehetgruber, Neuhofen/Ybbs (AT)

(73) Assignee: GFM—GmbH, Steyr (AT)

( * ) Notice: Subject to any disclaimer, the term of this patent is extended or adjusted under 35 U.S.C. 154(b) by 262 days.

(21) Appl. No.: 15/531,921

(22) PCT Filed: Dec. 15, 2015

(86) PCT No.: PCT/AT2015/050317

§ 371 (c)(1),
(2) Date: May 31, 2017

(87) PCT Pub. No.: WO2016/094919

PCT Pub. Date: Jun. 23, 2016

(65) Prior Publication Data

US 2017/0320125 A1 Nov. 9, 2017

(30) Foreign Application Priority Data

Dec. 16, 2014 (AT) ..... A50911/2014

(51) Int. Cl.
*B21J 13/02* (2006.01)
*B21J 1/02* (2006.01)
(Continued)

(52) U.S. Cl.
CPC ..... *B21J 13/02* (2013.01); *B21J 1/025* (2013.01); *B21J 7/14* (2013.01); *C21D 7/10* (2013.01); *C21D 7/02* (2013.01)

(58) Field of Classification Search
CPC ..... B21J 1/025; B21J 7/00; B21J 7/02; B21J 7/14; B21J 13/00; B21J 13/02; C21D 7/02; C21D 7/10
See application file for complete search history.

(56) References Cited

U.S. PATENT DOCUMENTS 3,769,825 A 11/1973 Reznar et al.
4,276,764 A * 7/1981 Kozhevnikov ..... B21J 5/02 72/275

(Continued)

FOREIGN PATENT DOCUMENTS

FR 2 147 980 A1 3/1973
RU 2 047 415 C1 11/1995

(Continued)

OTHER PUBLICATIONS

International Search Report of PCT/AT2015/050317, dated Mar. 17, 2016.

*Primary Examiner* — Teresa M Ekiert
(74) *Attorney, Agent, or Firm* — Collard & Roe, P.C.

(57) ABSTRACT

A description is given of a method and a device for forging a rod-shaped workpiece (5) which is deformed with the aid of forging tools (1, 2, 3, 4) in the sense of a cross-sectional displacement perpendicular to the forging axis (a) and is subjected to an axial advancement and possibly a rotation about the forging axis (a) during the pauses in the engagement of the forging tools (1, 2, 3, 4). In order to achieve an advantageous grain refinement, it is proposed that the workpiece (5) is deformed in the sense of the cross-sectional displacement perpendicular to the forging axis (a) in a bending zone (13) between two central supports (11) by means of the forging tools (1, 2, 3, 4) acting on the workpiece (5) radially in relation to the forging axis (a).

7 Claims, 5 Drawing Sheets

(51) Int. Cl.

| | |
|---|---|
| ***B21J 7/14*** | (2006.01) |
| ***C21D 7/10*** | (2006.01) |
| ***C21D 7/02*** | (2006.01) |

(56) References Cited

U.S. PATENT DOCUMENTS 4,982,596 A * 1/1991 Peterson ..... B21J 13/02
470/191
6,571,593 B1 6/2003 Chung et al.

FOREIGN PATENT DOCUMENTS

| | | | |
|---|---|---|---|
| RU | 2 406 588 | C2 | 12/2010 |
| SU | 925 503 | A1 | 5/1982 |
| WO | 2011/073745 | A2 | 6/2011 |

* cited by examiner

METHOD AND DEVICE FOR FORGING A WORKPIECE IN BAR FORM

CROSS REFERENCE TO RELATED APPLICATIONS

This application is the National Stage of PCT/AT2015/050317 filed on Dec. 15, 2015, which claims priority under 35 U.S.C. § 119 of Austrian Application No. A50911/2014 filed on Dec. 16, 2014, the disclosure of which is incorporated by reference. The international application under PCT article 21(2) was not published in English.

TECHNICAL FIELD

The invention relates to a method for forging a rod-shaped workpiece which is deformed with the aid of forging tools in the sense of a cross-sectional displacement perpendicular to the forging axis and is subjected to an axial advancement and possibly a rotation about the forging axis during the pauses in the engagement of the forging tools, and to a device for carrying out the method.

PRIOR ART

During the forging of workpieces which are subjected to an axial advancement and possibly a rotation about the forging axis during the pauses in the engagement of the forging tools, not only is a cross-sectional reduction of the workpiece blank achieved by means of the forging tools arranged in pairs opposite one another and acting radially on the workpiece blank, but also the grain structure of the workpiece is improved. The change in the grain structure depends on various forging parameters, such as the forging temperature, the rate of advancement, the size of the cross-sectional reduction and the rate of deformation, so that these parameters can also be used to influence the grain structure of the forged workpiece. However, the possibility of influencing the grain structure by changing these parameters is limited, particularly in terms of achieving a grain structure that is as uniform as possible over the workpiece cross-section.

For the grain refinement of metal workpieces, it is also known (U.S. Pat. No. 6,571,593 B1) to press the workpiece, by means of rolls that bring about a cross-sectional reduction, through a subsequent die which forms a deflection channel for the rolled workpiece in order to achieve the desired grain refinement as a result of the shear forces occurring in the workpiece upon a deflection with a small deflection radius. However, owing to the forces that have to be applied, such devices are suitable only for relatively small workpiece cross-sections.

This disadvantage is overcame by a forging method (RU 2 406 588 C2) in which the workpiece is machined between four hammers arranged in pairs opposite one another, of which an upper hammer cooperates with a stationary lower hammer while the lateral hammers are moved downward at 45°, so that the workpiece is deformed in the sense of a cross-sectional displacement perpendicular to the forging axis, with the effect that a grain refinement can be achieved as a result of the additional shear stresses associated therewith, but only to a limited extent, despite the construction effort involved on account of the particular hammer guidance.

SUMMARY OF THE INVENTION

The problem addressed by the invention is thus that of specifying a method by which the structure can be considerably improved even for workplaces with larger cross-sectional dimensions.

Proceeding from a method of the type outlined above, the invention solves the stated problem in that the workpiece is deformed in the sense of the cross-sectional displacement perpendicular to the forging axis in a bending zone between two central supports by means of the forging tools acting on the workplace radially in relation to the forging axis.

Since, as a result of this measure, the workpiece is supported centrally on both sides of a bending zone and between these central supports is bent out of a position coaxial to the forging axis by forging tools acting radially in relation to the forging axis, transverse loads occur both during the bending of the workpiece out of the forging axis and during the bending thereof back into the forging axis, and these transverse loads lead to shear stresses which are distributed over the cross-section and which ensure a notable grain refinement over the entire cross-section of the workpiece. With the aid of the forging tools used for this purpose, even workpieces having relatively large cross-sectional dimensions can easily be machined in at least one pass.

Particularly advantageous conditions for improving the grain structure are obtained if the workpiece is subjected to a forging reduction in front of the bending zone in the advancement direction, because the influences of the forging parameters on the crystalline structure of the workpiece can advantageously be used in conjunction with the additional bending-reducing cross-sectional displacement perpendicular to the forging axis. After the grain refinement by bending out the workpiece by means of forging tools, the workpiece can be subjected to a further cross-sectional reduction, which brings about the additional advantage of a precise guidance coaxial to the forging axis. A final finish-machining gives rise to a suitable surface quality. The forging-induced cross-sectional reduction of a workpiece as well as the final finishing forces a workpiece position coaxial to the forging axis, so that the workpiece, during the reduction forging and/or during the finishing, can be supported centrally for the bending deformation without additional measures.

To carry out a forging method according to the invention, it is possible to start from conventional forging devices with forging tools arranged in pairs opposite one another in relation to the forging axis. It is merely necessary to ensure that the forging tools have, in the region of the bending zone, moulding surfaces which form a mould cross-section that is eccentric in relation to the forging axis. If separate forging tools are used for the bending zone, the desired transverse displacement of the workpiece brought about by the forging tools can be ensured by an asymmetrical setting of the forging tools in relation to the forging axis. In order to achieve a bending course that meets the respective requirements, however, it is advantageous to provide the forging tools, which are located opposite one another and can be set radially in a symmetrical manner in relation to the forging axis, with moulding surfaces which, due to a different distance from the forging axis, give rise to a cross-section of the workpiece that is eccentric in relation to the forging axis, and hence a transverse displacement of the workpiece.

Such moulding surfaces at different distances from the forging axis, which are formed by the forging tools arranged in pairs opposite one another, are necessary for the outward bending of the workpiece according to the invention when said moulding surfaces forming a mould cross-section that is eccentric in relation to the forging axis are provided between inlet-side and outlet-side moulding surfaces for a mould cross-section that is coaxial to the forging axis. With such a configuration of the forging tools, the central support of the workpiece immediately before and after the bending zone is formed by the forging tools themselves, namely with the advantage that the bending course for the workpiece can be consistently predefined.

If the inlet-side moulding surfaces form a mould cavity that tapers in the advancement direction, a cross-sectional reduction in conjunction with an additional grain refinement is achieved in a conventional manner by a deflection of the workpiece transversely to the forging axis. On the outlet side, the moulding surfaces may likewise ensure a cross-sectional reduction. In addition, the outlet-side moulding surfaces of the forging tools may form a finishing tool in order to obtain after the forging operation a workpiece having a fine-grained structure and a good surface quality.

BRIEF DESCRIPTION OF THE DRAWING

The method according to the invention for forging workpieces will be explained in greater detail with reference to the drawing. In the drawing

WAY OF IMPLEMENTING THE INVENTION

Figure 1:
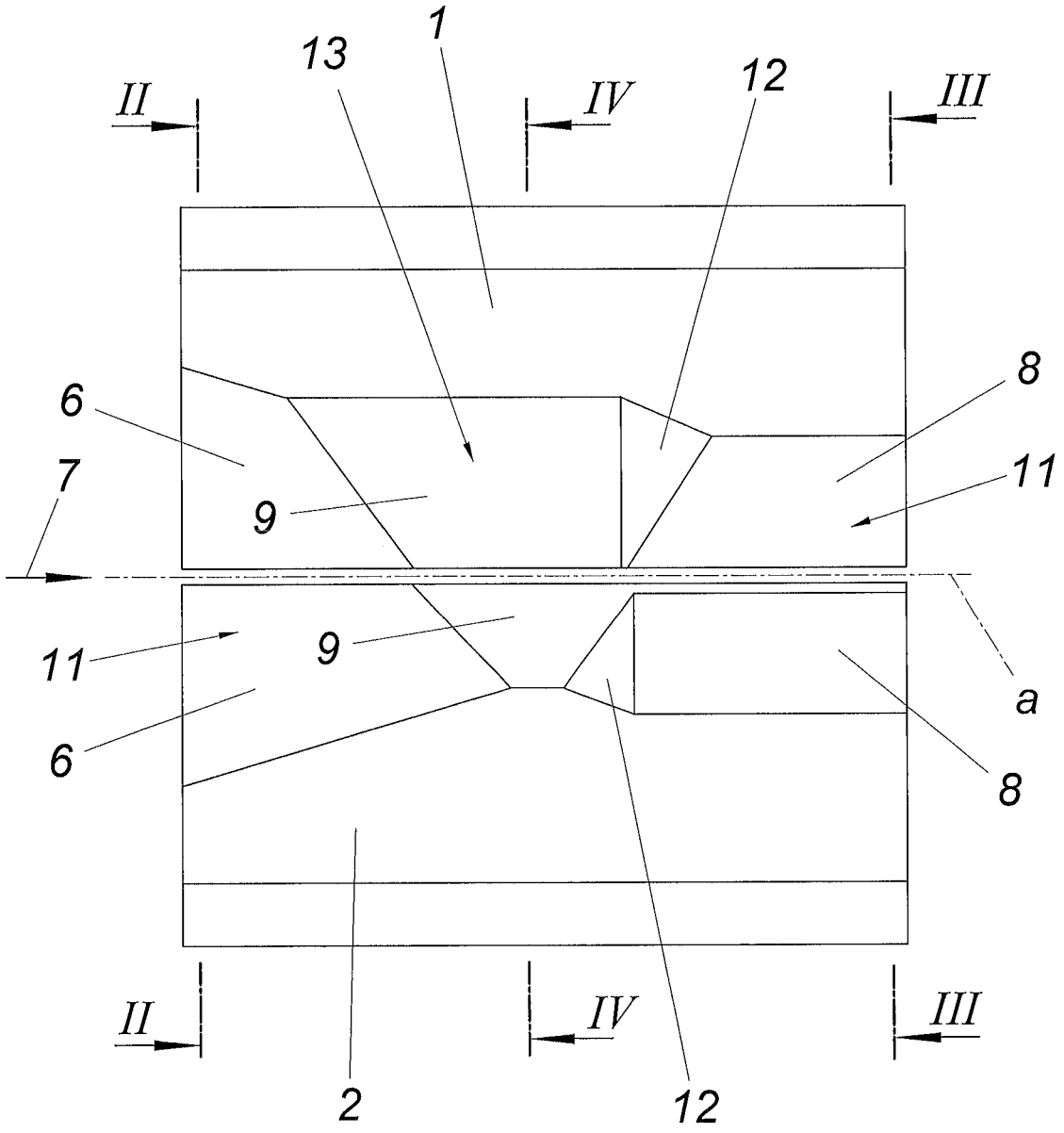
FIG. 1 shows, in a view of the moulding surfaces, two of the four forging tools of a forging device according to the invention, said forging tools being arranged in pairs opposite one another and being set so as to form a mould cavity.
Figure 2:
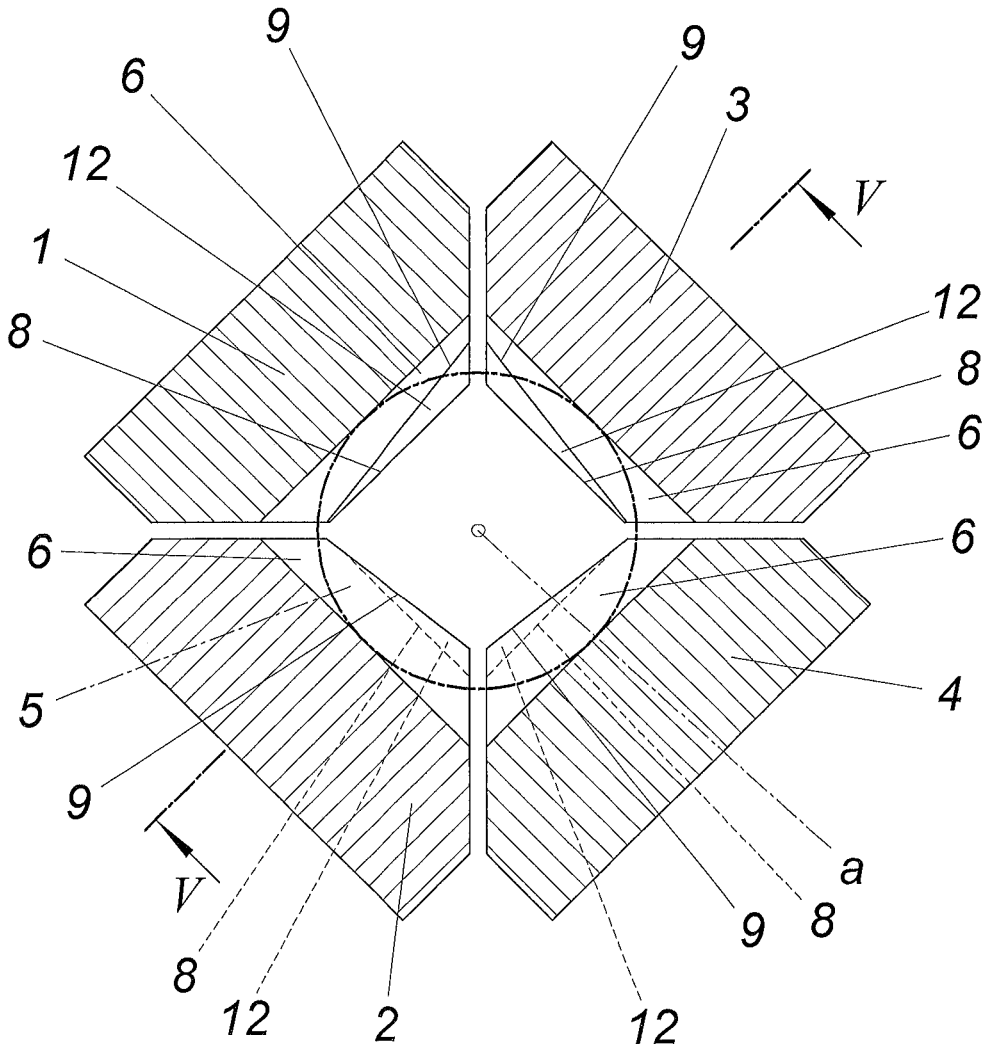
FIG. 2 shows a sectional view along the line II-II of FIG. 1.
Figure 3:
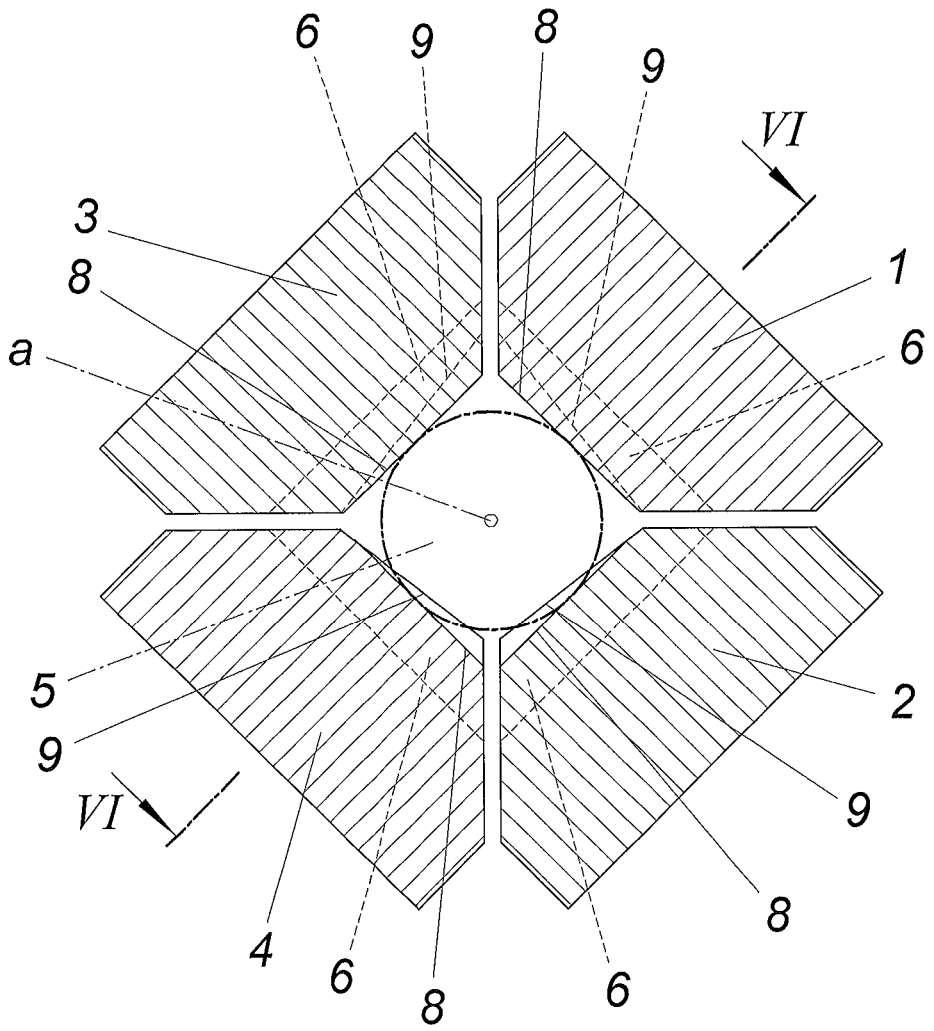
FIG. 3 shows a sectional view along the line III-III of FIG. 1.

Of the forging device constructed in a known manner, only the four forging tools 1, 2, 3, 4 are shown in the illustrated exemplary embodiment, said forging tools being arranged in pairs opposite one another and being able to be acted upon radially in relation to a forging axis a, the setting shown forming the mould cavity for a rod-shaped workpiece 5 that is indicated in dash-dotted line. Said forging tools 1, 2, 3, 4 form inlet-side moulding surfaces 6, which create a mould cavity coaxial to the forging axis a and which give rise to a cross-sectional reduction on account of their course being inclined in the advancement direction 7. On the outlet side, moulding surfaces 8 are provided, which likewise define a mould cavity coaxial to the forging axis a and advantageously ensure an additional cross-sectional reduction, which aids the central guidance of the workpiece 5 in the region of the outlet-side moulding surfaces 8. The outlet-side moulding surfaces can also be used as a finishing tool.

Figure 4:
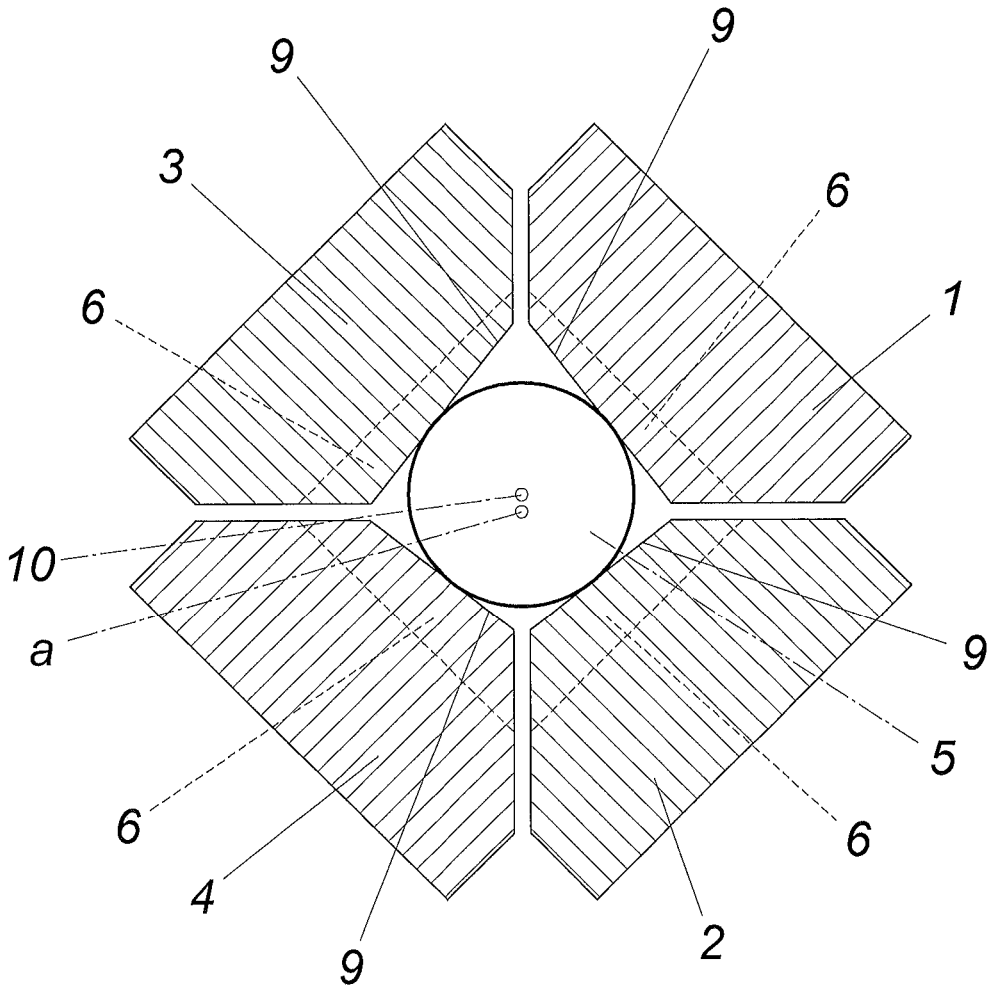
FIG. 4 shows a sectional view along the line IV-IV of FIG. 1.

Between the inlet-side and outlet-side moulding surfaces 6, 8, the forging tools 1 to 4 form moulding surfaces 9 which define for the workpiece 5 a mould cross-section that is eccentric in relation to the forging axis a, as can be seen in particular in FIG. 4, in which it is possible to see the transverse displacement of the workpiece 5 in relation to the forging axis a that is brought about by the moulding surfaces 9. The axis of the workpiece cross-section is denoted 10 and runs in an offset manner in relation to the forging axis a, so that the workpiece 5 is bent out in relation to the inlet-side and outlet-side supports 11 which are formed by the moulding surfaces 6 and 8 and guide the workpiece 5 coaxially in relation to the forging axis a. The return of the workpiece 5 into a position which is coaxial to the forging axis a takes place via transition surfaces 12, as can be seen in particular in FIG. 1.

Figure 5:
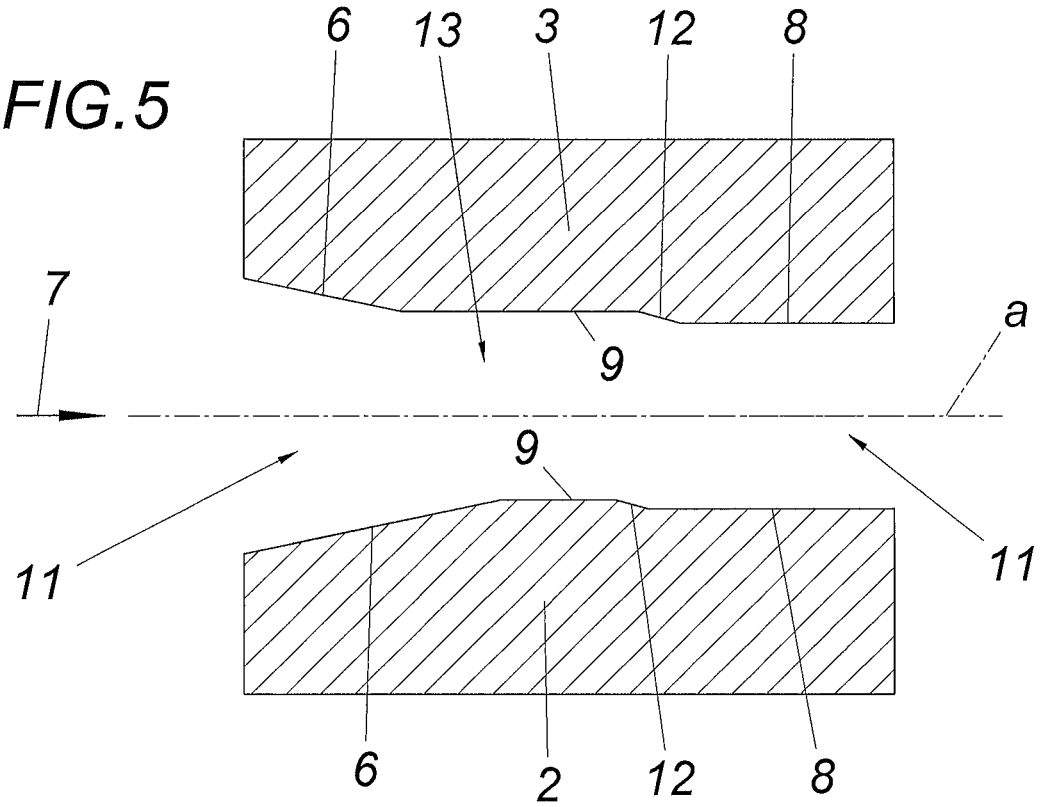
FIG. 5 shows a sectional view along the line V-V of FIG. 2.
Figure 6:
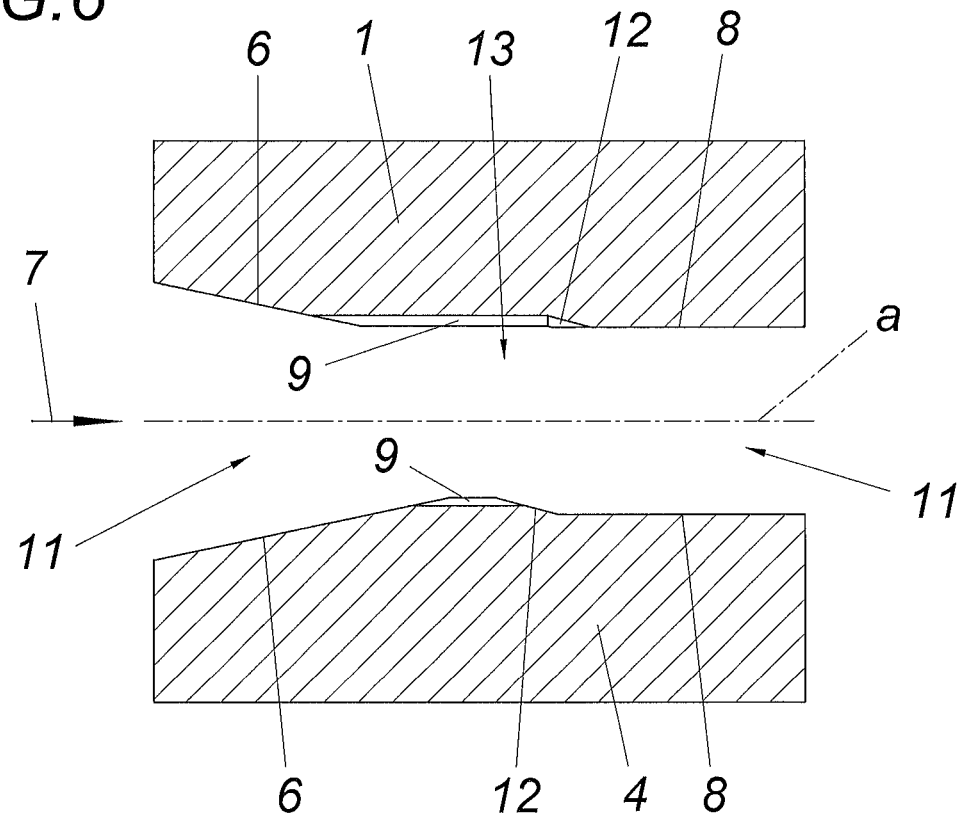
FIG. 6 shows a sectional view along the line VI-VI of FIG. 3.

By providing the moulding surfaces 9 which bring about a transverse displacement of the workpiece cross-section, a bending zone 13 is thus created by the forging tools 1, 2, 3, 4, in which bending zone the workpiece 5 is exposed to additional shear stresses over the cross-section, which ensure a corresponding grain refinement over the entire cross-section of the workpiece 5, the latter being subject to an advancement with simultaneous rotation between the engagements of the forging tools 1 to 4. The forging-induced workpiece deflection transversely to the forging axis a is particularly clear in FIGS. 1, 5 and 6. For clarity reasons, the respective forging tool 1 or 2 located between the cut-away forging tools 3 and 2 or 1 and 4 is omitted in FIGS. 5 and 6.

The invention is of course not limited to the exemplary embodiment shown. For instance, the grain refinement according to the invention can also be used in the case of workpieces having a right-angled cross-section. In this case, the workpiece rotation during the advancement steps is omitted. Although it is advantageous to ensure the entire deformation process by the forging tools 1 to 4 arranged in pairs opposite one another, the invention is not limited to this embodiment. For instance, the supports 11 formed by the moulding surfaces 6 and 8 could be arranged upstream and downstream of the forging tools, so that the forging tools merely have the task of forming a bending zone 13 for the workpiece 5, for which purpose only two oppositely arranged forging tools are required. The supports 11 could be formed by upstream and downstream forging tools, but this is not mandatory since the supports 11 for the central guidance of the workpiece 5 coaxial to the forging axis a need not be in the form of forging tools.

It would also be possible to provide three central supports 11 for the workpiece 5, in order to be able to arrange a bending zone 13 between each of said supports so that the workpiece 5 is bent twice in succession.

The invention claimed is:

1. A method for forging a rod-shaped workpiece, the method comprising:

providing forging tools having molding surfaces between inlet-side and outlet-side molding surfaces for a mold cross-section that is coaxial to a forging axis, the inlet-side and outlet-side molding surfaces forming two central supports, the forging tools being arranged in pairs opposite one another, the forging tools forming a bending zone between the two central supports;

introducing the workpiece into the inlet-side molding surfaces and into the bending zone;

deforming the workpiece, with the aid of the forging tools, as a result of a cross-sectional displacement of the forging tools perpendicular to the forging axis such that the forging tools engage the workpiece;

subjecting the workpiece to a plurality of axial advancements, and possibly a rotation about the forging axis, during pauses in the engagement of the forging tools;

bending, in the bending zone, the workpiece out of a position coaxial to the forging axis (a) via the forging tools acting on the workpiece radially in relation to the forging axis; and after the bending out and after an axial advancement of the workpiece within the bending zone, bending, in the bending zone, the workpiece back into the forging axis via the forging tools acting on the workpiece radially in relation to the forging axis.

2. The method according to claim 1, wherein the workpiece is subjected to a forging reduction in front of the bending zone in the advancement direction.

3. The method according to claim 1, wherein the workpiece is subjected to a cross-sectional reduction and/or a finishing operation after the bending zone in the advancement direction.

4. The method according to claim 2, wherein the workpiece is supported centrally for the bending deformation during the forging reduction and/or during finishing.

5. A device for carrying out a method for forging a workpiece, the device comprising:

inlet-side molding surfaces;

outlet-side molding surfaces; and first, second, third, and fourth forging tools which are arranged in pairs opposite one another in relation to a forging axis, the first, second, third, and fourth forging tools being disposed between the inlet-side molding surfaces and the outlet-side molding surfaces, wherein the first, second, third, and fourth forging tools have molding surfaces;

wherein the device has a forging axis;

wherein a mold cross-section of the inlet-side molding surfaces and the outlet-side molding surfaces is coaxial to the forging axis;

wherein the inlet-side and outlet-side molding surfaces form central supports; and wherein the molding surfaces of the first, second, third, and fourth forging tools form a mold cross-section that is eccentric in relation to the forging axis in such a way that the workpiece, between the central supports, is bent out of a position coaxial to the forging axis and is bent back into the forging axis.

6. The device according to claim 5, wherein the inlet-side molding surfaces form a mold cavity that tapers in an advancement direction.

7. The device according to claim 5, wherein the outlet-side molding surfaces form a mold cavity that tapers in an advancement direction and/or a finishing tool.

* * * * *